US010746471B2

(12) United States Patent
Laaninen et al.

(10) Patent No.: US 10,746,471 B2
(45) Date of Patent: Aug. 18, 2020

(54) METHOD AND ARRANGEMENT FOR CONTROLLING A BURNER OF A SUSPENSION SMELTING FURNACE

(71) Applicant: OUTOTEC (FINLAND) OY, Espoo (FI)

(72) Inventors: Aki Laaninen, Espoo (FI); Jaana Romppanen, Helsinki (FI); Peter Björklund, Espoo (FI); Valtteri Sonninen, Helsinki (FI); Jani Jansson, Vantaa (FI)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 16/675,364

(22) Filed: Nov. 6, 2019

(65) Prior Publication Data

US 2020/0080784 A1 Mar. 12, 2020

Related U.S. Application Data

(63) Continuation of application No. PCT/FI2017/050399, filed on May 29, 2017.

(51) Int. Cl.
*F27D 21/02* (2006.01)
*F27D 3/16* (2006.01)
(Continued)

(52) U.S. Cl.
CPC ..... *F27D 21/02* (2013.01); *F27B 15/10* (2013.01); *F27B 15/14* (2013.01); *F27D 3/16* (2013.01);
(Continued)

(58) Field of Classification Search
CPC ..... F23D 14/00; F27B 15/10; F27B 15/14; F27D 2021/026; F27D 21/02; F27D 3/16; F27D 3/18; F27D 99/0033
(Continued)

(56) References Cited

U.S. PATENT DOCUMENTS 5,362,032 A * 11/1994 Ranki ..... F27D 3/16 266/182
8,889,059 B2 * 11/2014 Gonzalez ..... C22B 15/0047 266/100
(Continued)

FOREIGN PATENT DOCUMENTS

EP 3042966 A1 7/2016
JP 2011225904 A 11/2011
(Continued)

OTHER PUBLICATIONS

International Search Report issued by the Finnish Patent and Registration Office acting as the International Search Authority in relation to International Application No. PCT/FI2017/050399 dated Sep. 18, 2017 (4 pages).
(Continued)

*Primary Examiner* — Jessee R Roe
*Assistant Examiner* — Michael Aboagye
(74) *Attorney, Agent, or Firm* — Robert P. Michal, Esq.; Carter, DeLuca & Farrell LLP

(57) ABSTRACT

A method and an arrangement for controlling a burner of a suspension smelting furnace. The burner includes a reaction gas feeding device, and a fine solids feeding device. The fine solids feeding device being at an upstream end of the fine solids feeding device pivotably supported in the reaction gas feeding device. The burner including by at least one first mechanical actuator configured to center the fine solids feeding device in the annular reaction gas outlet opening. Said at least one first mechanical actuator being in response to receiving the control signal configured to perform a centering action to center the fine solids channel in the annular reaction gas outlet opening.

18 Claims, 2 Drawing Sheets

Figure 1:
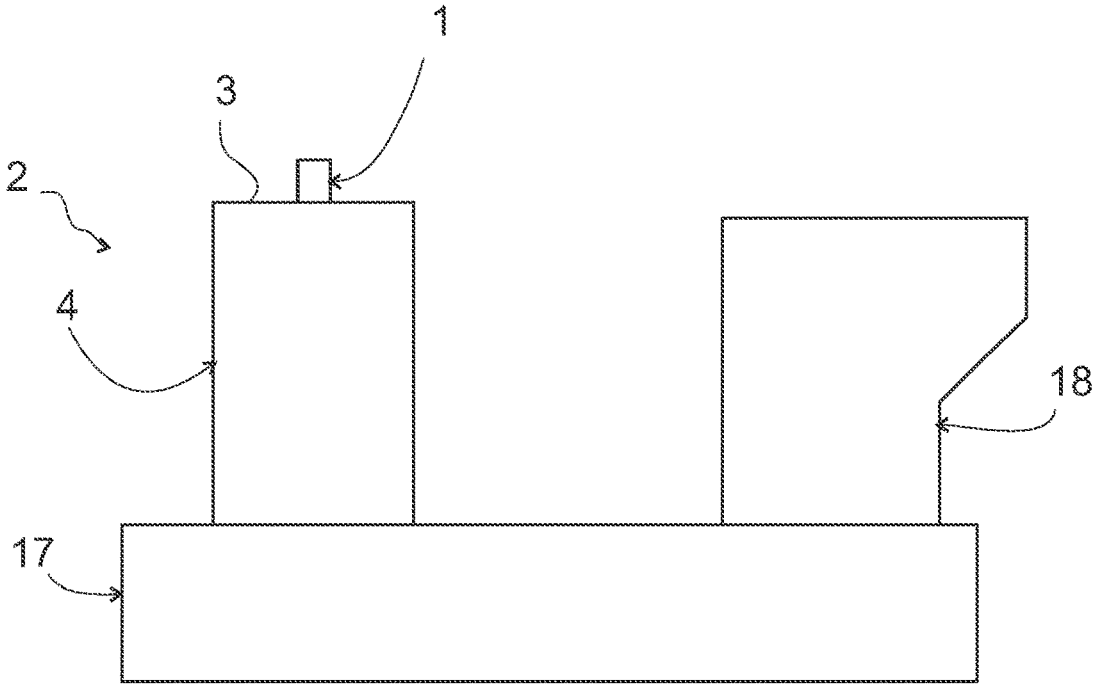

(51) Int. Cl.
*F27D 3/18* (2006.01)
*F27B 15/14* (2006.01)
*F27B 15/10* (2006.01)

(52) U.S. Cl.
CPC ..... *F27D 3/18* (2013.01); *F27D 2021/026* (2013.01)

(58) Field of Classification Search
USPC ..... 266/44, 80, 216, 197, 265, 266, 267
See application file for complete search history.

(56) References Cited

U.S. PATENT DOCUMENTS

| | | | | |
|---|---|---|---|---|
| 9,845,993 | B2 * | 12/2017 | Bjorklund | C22B 15/0028 |
| 10,209,007 | B2 * | 2/2019 | Laaninen | F23N 5/082 |
| 10,605,531 | B2 * | 3/2020 | Laaninen | F27D 19/00 |

FOREIGN PATENT DOCUMENTS

| | | | |
|---|---|---|---|
| WO | 2012151670 | A1 | 11/2012 |
| WO | 2015155415 | A1 | 10/2015 |

OTHER PUBLICATIONS

Written Opinion of the International Searching Authority issued by the Finnish Patent and Registration Office acting as the International Search Authority in relation to International Application No. PCT/FI2017/050399 dated Sep. 18, 2017(7 pages).

International Preliminary Report on Patentability issued by the European Patent Office acting as the International Preliminary Examining Authority in relation to International Application No. PCT/FI2017/050399 dated May 17, 2019 (5 pages).

* cited by examiner

METHOD AND ARRANGEMENT FOR CONTROLLING A BURNER OF A SUSPENSION SMELTING FURNACE

CROSS-REFERENCE TO RELATED APPLICATIONS

This application is a continuation of PCT International Application No. PCT/FI2017/050399 filed May 29, 2017, the disclosure of this application is expressly incorporated herein by reference in its entirety.

FIELD OF THE INVENTION

The invention relates to a method for controlling a burner such as a concentrate or matte burner of a suspension smelting furnace such as a flash smelting furnace or a flash converting furnace.

The invention also relates to an arrangement for controlling a burner such as a concentrate or matte burner of a suspension smelting furnace such as a flash smelting furnace or a flash converting furnace.

Publication WO 2012/151670 presents a burner and feed apparatus for flash smelter comprising a burner block that integrates with the roof of the furnace, the block having a nozzle opening therethrough to communicate with the reaction shaft of the furnace; a wind box to supply combustion gas to the reaction shaft through the nozzle opening, the wind box being mounted over the block; an injector having a sleeve for delivering pulverous feed material to the furnace and having a central lance within the sleeve to supply compressed air for dispersing the pulverous feed material in the reaction shaft, the injector mounting within the wind box so as to extend through the nozzle opening in the block, defining therewith an annular channel through which combustion gas from the wind box is supplied into the reaction shaft; and an injector surrounding structure extending from the wind box through the nozzle opening in the block. The injector sleeve is supported by three mechanical screw actuators. The actuators serve to adjust the height of the sleeve as well as to center the injector. They allow for precise raising and lowering of the sleeve when they are moved in unison so as to control the velocity of the combustion gas, and they allow for centering of the injector when they are controlled separately. The centering can be automated by having three feedback sensors that provide feedback of the relative height of each of the actuators to the controller. A disadvantage of this known burner is that it requires a quite complicated feedback sensor arrangement, because centering of the injector can affect the velocity of the combustion gas and vice versa.

OBJECTIVE OF THE INVENTION

The object of the invention is to solve the above-identified problem.

SHORT DESCRIPTION OF THE INVENTION

In the method and in the arrangement, the imaging apparatuses and the processing device provides for a simple feedback arrangement with great accuracy for determining centrality of the fine solids feeding device in the reaction gas feeding device so that the at least one first mechanical actuator, if needed can perform a centering action to ensure that a symmetrical annular reaction gas outlet opening is formed.

Separate second mechanical actuators may be provided for controlling the velocity of the combustion gas that flows through the annular reaction gas outlet opening.

LIST OF FIGURES

Figure 2:
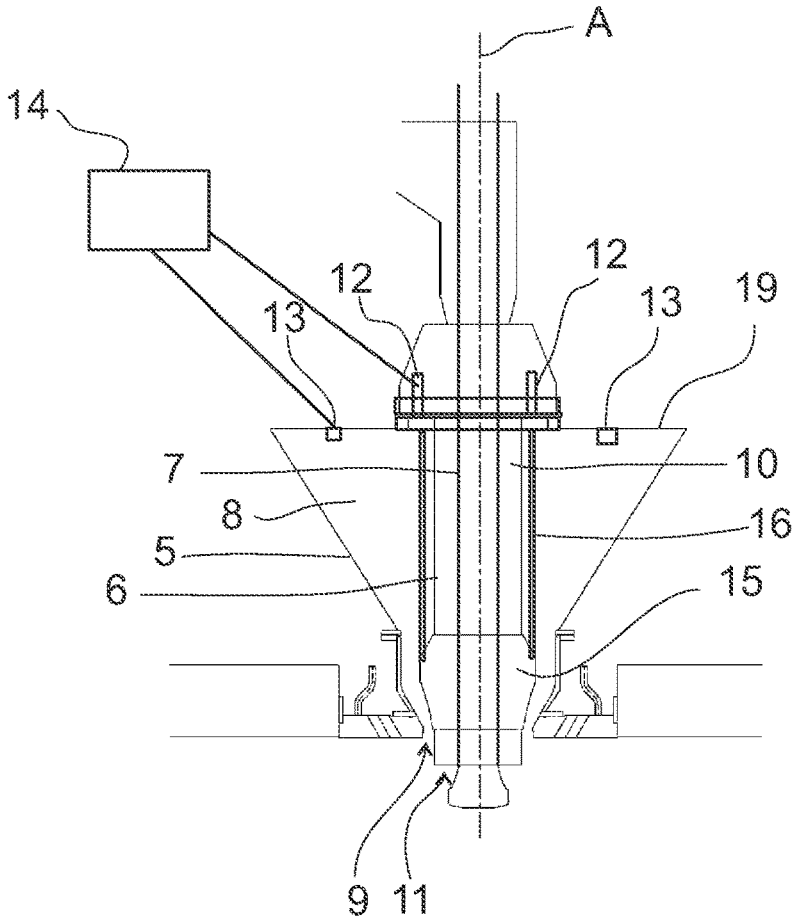
Figure 3:
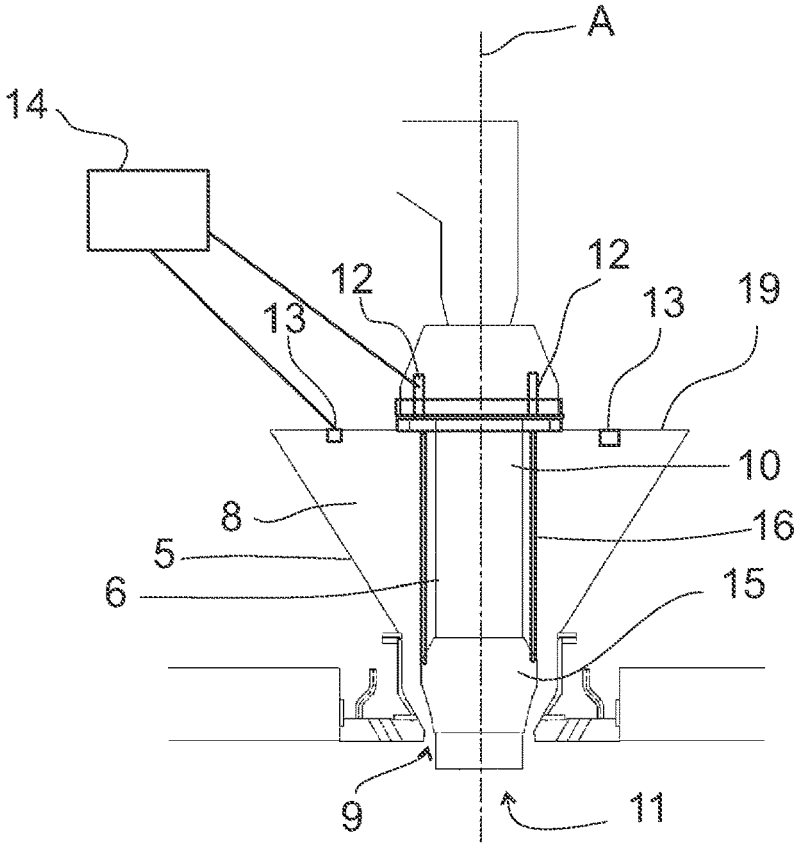
Figure 4:
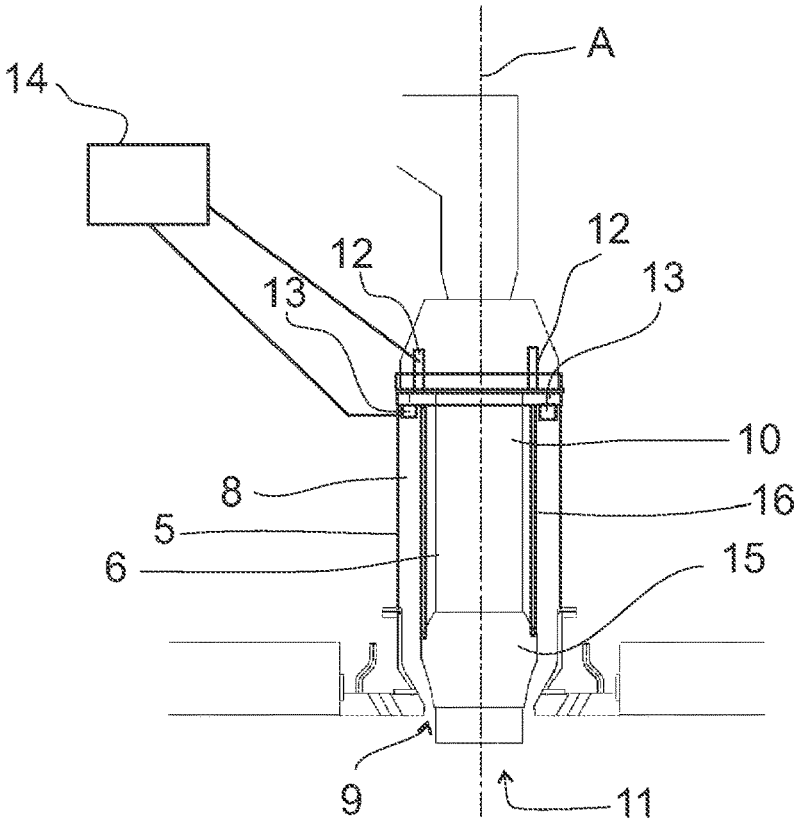

In the following the invention will be described in more detail by referring to the figures, which FIG. 1 shows a suspension smelting furnace, FIG. 2 shows in cross section a burner in a first embodiment, FIG. 3 shows in cross section a burner in a second embodiment, and FIG. 4 shows in cross section a burner in a third embodiment.

DETAILED DESCRIPTION OF THE INVENTION

First the method for controlling a burner 1 such as a concentrate or matte burner of a suspension smelting furnace 2 such as a flash smelting furnace or a flash converting furnace and some embodiments and variants of the method will be described in greater detail.

In the method, the burner 1 is arranged at the top structure 3 of a reaction shaft 4 of the suspension smelting furnace 2. The suspension smelting furnace 2 shown in FIG. 1 comprises additionally a settler 17 or a lower furnace that is in communication with a lower end of the reaction shaft 4 and an uptake shaft 18 having a lower end in communication with the settler 17.

The burner 1 comprises a reaction gas feeding device 5 and a fine solids feeding device 6.

The reaction gas feeding device 5 surrounds the fine solids feeding device 6 so that an annular reaction gas channel 8 is formed between the reaction gas feeding device 5 and the fine solids feeding device 6. The annular reaction gas channel 8 has an annular reaction gas outlet opening 9. The reaction gas feeding device 5 can comprise a reaction gas feeding chamber (not marked with a reference numeral) as shown in FIGS. 2 and 3 or be in the form of a tubular piece (not with a reference numeral) as shown in FIG. 3.

The fine solids feeding device 6 has a fine solids channel 10 having a fine solids outlet opening 11.

The burner 1, can as in the first embodiment shown in FIG. 2, comprise a dispersion gas feeding device 7 surrounded by the fine solids feeding device 6 so that the fine solids channel 10 is formed between the fine solids feeding device 6 and the dispersion gas feeding device 7, and so that the annular fine solids channel 10 is annular and so that the fine solids outlet opening 11 is annular.

An upstream end of the fine solids feeding device 6 is pivotably connected to the reaction gas feeding device 5.

The burner 1 comprises at least one, preferably by, two, three or four first mechanical actuator(s) 12 configured to center the fine solids feeding device 6 in the annular reaction gas outlet opening 9 so as to produce a symmetrical annular reaction gas outlet opening 9.

It is possible that the fine solids feeding device 6 is at an upstream end of the fine solids feeding device 6 pivotably supported in the reaction gas feeding device 5 by one fastener (not shown in the figures) capable of pivoting and by two first mechanical actuators 12 configured to center the fine solids feeding device 6 in the annular reaction gas outlet opening 9 so as to produce a symmetrical annular reaction gas outlet opening 9.

The fine solids feeding device 6 can for example be mechanically attached with at least one of said at least one first mechanical actuators 12, and at least a mechanical fastener allowing the fine solids feeding device 6 to pivot with respect to the reaction gas feeding device 5.

It is also possible that the fine solids feeding device 6 is arranged in a spherical seat (not shown in the figures) allowing the fine solids feeding device 6 to pivot with respect to the reaction gas feeding device 5.

The method comprises arranging at least two, preferably three or four imaging apparatuses 13 such as digital cameras symmetrically with respect to a center line of the burner 1.

The method comprises producing images of the cross section of annular reaction gas outlet opening 9 with said at least two imaging apparatuses 13.

The method comprises receiving images of the cross section of annular reaction gas outlet opening 9 from said at least two imaging apparatuses 13 with a processing device 14 such as a computer.

The method comprises performing an analyzing action of the images of the cross section of annular reaction gas outlet opening 9 and producing a control signal to said at least one first mechanical actuator 12 based on said analyzing action.

The analyzing action can include comparing images of the cross section of annular reaction gas outlet opening 9 with a threshold image representing the cross section of annular reaction gas outlet opening 9.

In the analyzing action, things such as outgrowth affecting the shape such as the symmetricity, of the annular reaction gas outlet opening 9, can also be noticed.

The method comprises performing a centering action to center the fine solids channel in the annular reaction gas outlet opening 9 with said at least one first mechanical actuator 12 in response to receiving the control signal.

Said at least two imaging apparatuses 13 can be arranged at an upstream end wall 19 of the reaction gas feeding device 5. Said at least two imaging apparatuses 13 can be arranged at least partly outside the burner and optical means such as lenses, objectives and/or mirrors can be provided for providing vision between the cross section of annular reaction gas outlet opening 9 and said at least two imaging apparatuses 13. Alternatively, said at least two imaging apparatuses 13 can be arranged in the reaction gas channel 8 of the burner 1.

In an embodiment of the method, the first mechanical actuator(s) 12 comprises at least one of an electric motor, a servo motor, a hydraulic motor, a magnetic motor, and a pneumatic motor and a mechanical screw, a mechanical shaft, a rod, or the like driven by said at least one of an electric motor, a servo motor, a hydraulic motor, a magnetic motor, and a pneumatic motor. An advantage of this is that using first mechanical actuator(s) 12 comprising at least one of an electric motor, a servo motor, a hydraulic motor, a magnetic motor, and a pneumatic motor and a mechanical screw, a mechanical shaft, a rod, or the like driven by said at least one of an electric motor, a servo motor, a hydraulic motor, a magnetic motor, and a pneumatic motor provides for precise centering of the fine solids feeding device 6 in the annular reaction gas outlet opening 9.

An embodiment of the method comprises providing a movable sleeve 15 around the fine solids feeding device 6 at the annular reaction gas outlet opening 9 of the reaction gas channel 8, providing at least one second actuator configured to move the movable sleeve 15 along and with respect to the fine solids feeding device 6 to change the area of the cross section of the annular reaction gas outlet opening 9 of the reaction gas channel 8, and changing the area of the cross section of the annular reaction gas outlet opening 9 of the reaction gas channel 8 by moving the movable sleeve 15 along and with respect to the fine solids feeding device 6. An advantage of this embodiment is that because separate mechanical actuators for centering the centering of the fine solids feeding device 6 in the annular reaction gas outlet opening 9 are provided and because separate mechanical actuators for positioning of the movable sleeve 15 with respect to the fine solids feeding device 6 such as with respect to the annular reaction gas outlet opening 9 of the reaction gas channel 8 i.e. adjusting of the feeding velocity of reaction gas, by adjusting the sleeve vertical position is a less complicated control system for ensuring that the centering of the injector does not affect the velocity of the combustion gas and vice versa can be used.

In an embodiment of the method, second mechanical actuators 16 comprising at least one of an electric motor, a servo motor, a hydraulic motor, a magnetic motor, and a pneumatic motor and a mechanical screw, a mechanical shaft, a rod, or the like driven by said at least one of an electric motor, a servo motor, a hydraulic motor, a magnetic motor, and a pneumatic motor. An advantage of this is that using second mechanical actuators 16 comprising at least one of an electric motor, a servo motor, a hydraulic motor, a magnetic motor, and a pneumatic motor and a mechanical screw, a mechanical shaft, a rod, or the like driven by at least one of an electric motor, a servo motor, a hydraulic motor, a magnetic motor, and a pneumatic motor provides for precise positioning of the movable sleeve 15 with respect to the fine solids feeding device 6.

In the method, the first mechanical actuator(s) 12 are preferably, but not necessarily, solely used for tilting the fine solids feeding device 6 with respect to a center line A of the burner 1. In the method, the first mechanical actuator(s) 12 are preferably, but not necessarily solely configured to tilt the fine solids feeding device 6 with respect to the annular reaction gas outlet opening 9 of the annular reaction gas channel 8 of the reaction gas feeding device 5 of the burner 1.

Next the arrangement for controlling a burner 1 such as a concentrate or a matte burner of a suspension smelting furnace 2 such as a flash smelting furnace or a flash converting furnace and some embodiments and variants of the arrangement will be described in greater detail.

In the arrangement, the burner 1 is arranged at the top structure 3 of a reaction shaft 4 of the suspension smelting furnace 2. The suspension smelting furnace 2 shown in FIG. 1 comprises additionally a settler 17 or a lower furnace that is in communication with a lower end of the reaction shaft 4 and an uptake shaft 18 having a lower end in communication with the settler 17.

The burner 1 comprises a reaction gas feeding device 5 and a fine solids feeding device 6.

The reaction gas feeding device 5 surrounds the fine solids feeding device 6 so that an annular reaction gas channel 8 is formed between the reaction gas feeding device 5 and the fine solids feeding device 6, wherein the annular reaction gas channel 8 having an annular reaction gas outlet opening 9. The reaction gas feeding device 5 can comprise a reaction gas feeding chamber (not marked with a reference numeral) as shown in FIGS. 2 and 3 or be in the form of a tubular piece (not with a reference numeral) as shown in FIG. 3.

The fine solids feeding device 6 surrounds the dispersion gas feeding device 7 so that an annular fine solids channel 10 is formed between the fine solids feeding device 6 and the dispersion gas feeding device 7, wherein the annular fine solids channel 10 having an annular fine solids outlet opening 11.

The burner 1, can as in the first embodiment shown in FIG. 2, comprise a dispersion gas feeding device 7 surrounded by the fine solids feeding device 6 so that the fine solids channel 10 is formed between the fine solids feeding device 6 and the dispersion gas feeding device 7, and so that the annular fine solids channel 10 is annular and so that the fine solids outlet opening 11 is annular.

The fine solids feeding device 6 is at an upstream end of the fine solids feeding device 6 pivotably supported in the reaction gas feeding device 5.

The burner 1 comprises at least one, preferably by two, three or four first mechanical actuator(s) 12 configured to center the fine solids feeding device 6 in the reaction gas outlet opening 9 so as to produce a symmetrical annular reaction gas outlet opening 9.

It is possible that the fine solids feeding device 6 is at an upstream end of the fine solids feeding device 6 supported in the reaction gas feeding device 5 by one fastener (not shown in the figures) capable of pivoting and by two first mechanical actuators 12 configured to center the fine solids feeding device 6 in the annular reaction gas outlet opening 9 so as to produce a symmetrical annular reaction gas outlet opening 9.

The fine solids feeding device 6 can for example be mechanically attached with at least one of said at least one first mechanical actuators 12, and at least a mechanical fastener allowing the fine solids feeding device 6 to pivot with respect to the reaction gas feeding device 5.

It is also possible that the fine solids feeding device 6 is arranged in a spherical seat (not shown in the figures) allowing the fine solids feeding device 6 to pivot with respect to the reaction gas feeding device 5.

At least two, preferably three or four imaging apparatuses 13 such as digital cameras are arranged symmetrically with respect to a center line A of the burner 1. Said at least two imaging apparatuses 13 are configured to produce images of the cross section of annular reaction gas outlet opening 9.

A processing mean is configured to receive images from the said at least two imaging apparatuses 13 and configured to perform an analyzing action of the images of the cross section of annular reaction gas outlet opening 9 and configured to produce a control signal to said at least one first mechanical actuator 12 based on said analyzing action.

The processing device 14 can be configured to perform an analyzing action including comparing images of the cross section of annular reaction gas outlet opening 9 with a threshold image representing the cross section of annular reaction gas outlet opening 9.

In the analyzing action, things such as outgrowth affecting the shape such as the symmetricity, of the annular reaction gas outlet opening 9, can also be noticed.

Said at least one first mechanical actuator 12 being in response to receiving the control signal configured to perform a centering action to center the fine solids feeding device 6 in the annular reaction gas-outlet opening 9.

Said at least two imaging apparatuses 13 can be arranged at an upstream end wall 19 of the reaction gas feeding device 5. Said at least two imaging apparatuses 13 can be arranged at least partly outside the burner and optical means such as lenses, objectives and/or mirrors can be provided for providing vision between the cross section of annular reaction gas outlet opening 9 and said at least two imaging apparatuses 13. Alternatively, said at least two imaging apparatuses 13 can be arranged in the reaction gas channel 8 of the burner 1.

In an embodiment of the arrangement, the first mechanical actuator(s) 12 comprises at least one of an electric motor, a servo motor, a hydraulic motor, a magnetic motor, and a pneumatic motor and a mechanical screw, a mechanical shaft, a rod, or the like driven by said at least one of an electric motor, a servo motor, a hydraulic motor, a magnetic motor, and a pneumatic motor. An advantage of this is that using first mechanical actuator(s) 12 comprising at least one of an electric motor, a servo motor, a hydraulic motor, a magnetic motor, and a pneumatic motor and a mechanical screw, a mechanical shaft, a rod, or the like driven by said at least one of an electric motor, a servo motor, a hydraulic motor, a magnetic motor, and a pneumatic motor provides for precise centering of the fine solids feeding device 6 in the annular reaction gas outlet opening 9.

In an embodiment of the arrangement, a movable sleeve 15 is arranged around the fine solids feeding device 6 at the annular reaction gas outlet opening 9 of the reaction gas channel 8, and at least one second actuator is configured to move the movable sleeve 15 along and with respect to the fine solids channel to change the area of the cross section of the annular reaction gas outlet opening 9 of the reaction gas channel 8. An advantage of this embodiment is that because separate first mechanical actuator(s) 12 for centering the centering of the fine solids feeding device 6 in the annular reaction gas outlet opening 9 are provided and because separate second mechanical actuators 16 for positioning of the movable sleeve 15 with respect to the fine solids feeding device 6 such as with respect to the annular reaction gas outlet opening 9 of the reaction gas channel 8 i.e. adjusting of the feeding velocity of reaction gas by adjusting the sleeve vertical position, a less complicated control system for ensuring that the centering of the injector does not affect the velocity of the combustion gas and vice versa can be used.

The second mechanical actuators 16 comprises preferably, but not necessarily, at least one of an electric motor, a servo motor, a hydraulic motor, a magnetic motor, and a pneumatic motor and a mechanical screw, a mechanical shaft, a rod, or the like driven by said at least one of an electric motor, a servo motor, a hydraulic motor, a magnetic motor, and a pneumatic motor. An advantage of this is that using second mechanical actuators 16 comprising at least one of an electric motor, a servo motor, a hydraulic motor, a magnetic motor, and a pneumatic motor and a mechanical screw, a mechanical shaft, a rod, or the like driven by at least one of an electric motor, a servo motor, a hydraulic motor, a magnetic motor, and a pneumatic motor provides for precise positioning of the movable sleeve 15 with respect to the fine solids feeding device 6.

In the arrangement, the first mechanical actuator(s) 12 are preferably, but not necessarily, solely configured to tilt the fine solids feeding device 6 with respect to a center line A of the burner 1. In the arrangement, the first mechanical actuator(s) 12 are preferably, but not necessarily, solely configured to tilt the fine solids feeding device 6 with respect to the annular reaction gas outlet opening 9 of the annular reaction gas channel 8 of the reaction gas feeding device 5 of the burner 1.

It is apparent to a person skilled in the art that as technology advanced, the basic idea of the invention can be implemented in various ways. The invention and its embodiments are therefore not restricted to the above examples, but they may vary within the scope of the claims.

The invention claimed is:

1. A method for controlling a burner of a suspension smelting furnace, wherein the burner is arranged at a top of a structure of a reaction shaft of the suspension smelting furnace and wherein the burner comprises:

a reaction gas feeding device, and a fine solids feeding device, wherein the reaction gas feeding device substantially surrounds the fine solids feeding device so that an annular reaction gas channel is formed between the reaction gas feeding device and the fine solids feeding device, wherein the annular reaction gas channel has an annular reaction gas outlet opening, wherein the fine solids feeding device has an annular fine solids channel having a fine solids outlet opening, wherein the fine solids feeding device has an upstream end pivotably connected to the reaction gas feeding device, and wherein the burner comprises at least one first mechanical actuator configured to center the fine solids feeding device in the annular reaction gas outlet opening, the method comprising the steps of:

arranging at least two imaging apparatuses symmetrically with respect to a center line A of the burner, producing images of a cross section of the annular reaction gas outlet opening with said at least two imaging apparatuses, receiving images of the cross section of the annular reaction gas outlet opening from said at least two imaging apparatuses with a processing device, performing an analyzing action of the images of the cross section of the annular reaction gas outlet opening by comparing the images of the cross section of the annular reaction gas outlet opening with a threshold image representing the cross section of the annular reaction gas outlet opening, producing and sending a control signal to said at least one first mechanical actuator based on said analyzing action, receiving said control signal by said at least one first mechanical actuator, and performing a centering action to center the fine solids feeding device in the annular reaction gas outlet opening with said at least one first mechanical actuator in response to receiving the control signal.

2. The method according to claim 1, wherein the at least one first mechanical actuator comprises at least one of an electric motor, a servo motor, a hydraulic motor, a magnetic motor, or a pneumatic motor and at least one of a mechanical screw, a mechanical shaft, or a rod driven by said at least one of the electric motor, the servo motor, the hydraulic motor, the magnetic motor, or the pneumatic motor.

3. The method according to claim 1, further comprises the steps of:

providing a movable sleeve around the fine solids feeding device at the annular reaction gas outlet opening of the reaction gas channel, providing at least one second actuator configured to move the movable sleeve along and with respect to the fine solids feeding device to change an area of the cross section of the annular reaction gas outlet opening of the reaction gas channel, and changing the area of the cross section of the annular reaction gas outlet opening of the reaction gas channel by moving the movable sleeve along and with respect to the fine solids feeding device.

4. The method according to claim 3, wherein the step of providing at least one second mechanical actuator comprises providing at least one of an electric motor, a servo motor, a hydraulic motor, a magnetic motor, or a pneumatic motor and at least one of a mechanical screw, a mechanical shaft, or a rod driven by said at least one of the electric motor, the servo motor, the hydraulic motor, the magnetic motor, and a or the pneumatic motor.

5. The method according to claim 1, further comprising the step of configuring said at least one first mechanical actuator to tilt the fine solids feeding device with respect to the center line A of the burner.

6. The method according to claim 1, further comprising the step of configuring the first mechanical actuator to tilt the fine solids feeding device with respect to the annular reaction gas outlet opening of the annular reaction gas channel of the reaction gas feeding device of the burner.

7. The method according to claim 1, wherein:

the burner comprises a dispersion gas feeding device, and the fine solids feeding device surrounds the dispersion gas feeding device so that the annular fine solids channel is formed between the fine solids feeding device and the dispersion gas feeding device, and the annular fine solids channel is annular and the fine solids outlet opening is annular.

8. The method according to claim 1, wherein the burner is a concentrate or a matte burner.

9. The method according to claim 1, wherein the suspension smelting furnace is a flash smelting furnace or a flash converting furnace.

10. An arrangement for controlling a burner of a suspension smelting furnace wherein the burner is arranged at the top structure of a reaction shaft of the suspension smelting furnace and wherein the burner comprises:

a reaction gas feeding device, and a fine solids feeding device, wherein the reaction gas feeding device substantially surrounds the fine solids feeding device so that an annular reaction gas channel is formed between the reaction gas feeding device and the fine solids feeding device, wherein the annular reaction gas channel has an annular reaction gas outlet opening, wherein the fine solids feeding device has a fine solids channel having a fine solids outlet opening, wherein the fine solids feeding device has an upstream end pivotably connected to the reaction gas feeding device, wherein the burner comprises at least one first mechanical actuator configured to center the fine solids feeding device in the annular reaction gas outlet opening, wherein at least two imaging apparatuses are symmetrically arranged with respect to a center line of the burner, said at least two imaging apparatuses being configured to produce images of a cross section of the annular reaction gas outlet opening, a processing device is configured to receive images from said at least two imaging apparatuses and configured to:

perform an analyzing action of the images of the cross section of the annular reaction gas outlet opening by comparing the images of the cross section of the annular reaction gas outlet opening with a threshold image representing the cross section of the annular reaction gas outlet opening; and produce and send a control signal and provide the control signal to said at least one first mechanical actuator based on said analyzing action, and said at least one first mechanical actuator being responsive to receiving the control signal and being configured to perform a centering action to center the fine solids channel in the annular reaction gas outlet opening.

11. The arrangement according to claim 10, wherein:

a movable sleeve is arranged substantially around the fine solids feeding device at the annular reaction gas outlet opening of the reaction gas channel, and at least one second actuator is configured to move the movable sleeve along and with respect to the fine solids channel to change the area of the cross section of the annular reaction gas outlet opening of the reaction gas channel.

12. The arrangement according to claim 11, wherein:

the second mechanical actuators comprise at least one of an electric motor, a servo motor, a hydraulic motor, a magnetic motor, or a pneumatic motor and at least one of a mechanical screw, a mechanical shaft, or a rod driven by said at least one of the electric motor, the servo motor, the hydraulic motor, the magnetic motor, and a or the pneumatic motor.

13. The arrangement according to claim 10, wherein:

said at least one first mechanical actuator comprises at least one of an electric motor, a servo motor, a hydraulic motor, a magnetic motor, or a pneumatic motor and at least one of a mechanical screw, a mechanical shaft, or a rod driven by said at least one of the electric motor, the servo motor, the hydraulic motor, the magnetic motor, or the pneumatic motor.

14. The arrangement according to claim 10, wherein:

said at least one first mechanical actuator being solely configured to tilt the fine solids feeding device with respect to the center line of the burner.

15. The arrangement according to claim 10, wherein:

said at least one first mechanical actuator being solely configured to tilt the fine solids feeding device with respect to the annular reaction gas outlet opening of the annular reaction gas channel of the reaction gas feeding device of the burner.

16. The arrangement according claim 10, wherein:

the burner comprises a dispersion gas feeding device, and the fine solids feeding device substantially surrounds the dispersion gas feeding device so that the fine solids channel is formed between the fine solids feeding device and the dispersion gas feeding device, and the fine solids channel is annular and the fine solids outlet opening is annular.

17. The arrangement according to claim 10, wherein the burner is a concentrate or a matte burner.

18. The arrangement according to claim 10, wherein the suspension smelting furnace is a flash smelting furnace or a flash converting furnace.

* * * * *